United States Patent [19]

Velasquez

[11] Patent Number: 4,719,439

[45] Date of Patent: Jan. 12, 1988

[54] CAMERA TUBE DEFLECTION YOKE THERMAL SADDLE

[75] Inventor: Juan F. Velasquez, Saline, Mich.

[73] Assignee: Applied Intellegent Systems, Inc., Ann Arbor, Mich.

[21] Appl. No.: 801,240

[22] Filed: Nov. 25, 1985

[51] Int. Cl.[4] ..... H01F 7/00

[52] U.S. Cl. ..... 335/210; 165/80.2; 165/185; 174/16 HS; 313/46; 313/365

[58] Field of Search ..... 335/210–211, 335/213, 217; 313/46, 365; 174/16 HS; 165/80.3, 80.2, 185

[56] References Cited

U.S. PATENT DOCUMENTS

| | | | |
|---|---|---|---|
| 3,629,750 | 12/1971 | Nienaber | 335/210 |
| 3,761,848 | 9/1973 | Sugiura | 335/210 |
| 3,893,161 | 7/1975 | Pesak, Jr. | 174/16 HS X |
| 3,919,597 | 11/1975 | Meacham | 313/46 X |
| 3,973,231 | 8/1976 | Saito et al. | 335/210 |

FOREIGN PATENT DOCUMENTS

| | | | |
|---|---|---|---|
| 60-63861 | 4/1985 | Japan | 313/365 |

*Primary Examiner*—Arthur T. Grimley
*Assistant Examiner*—Jane K. Lau
*Attorney, Agent, or Firm*—Basile and Hanlon

[57] ABSTRACT

A thermal saddle for a camera tube deflection yoke which dissipates heat from the camera tube and deflection yoke to enable the use of maximum operating voltages on the camera tube for enhanced resolution. The thermal saddle includes a base formed of a high heat dissipation material having spaced, planar flanges mounted within the camera housing. A concave, central portion is formed between the flanges and is sized to securely receive and support the deflection yoke and to dissipate heat therefrom. A strap surrounds the delection yoke and is secured to the base to securely mount the deflection yoke on the base.

1 Claim, 1 Drawing Figure

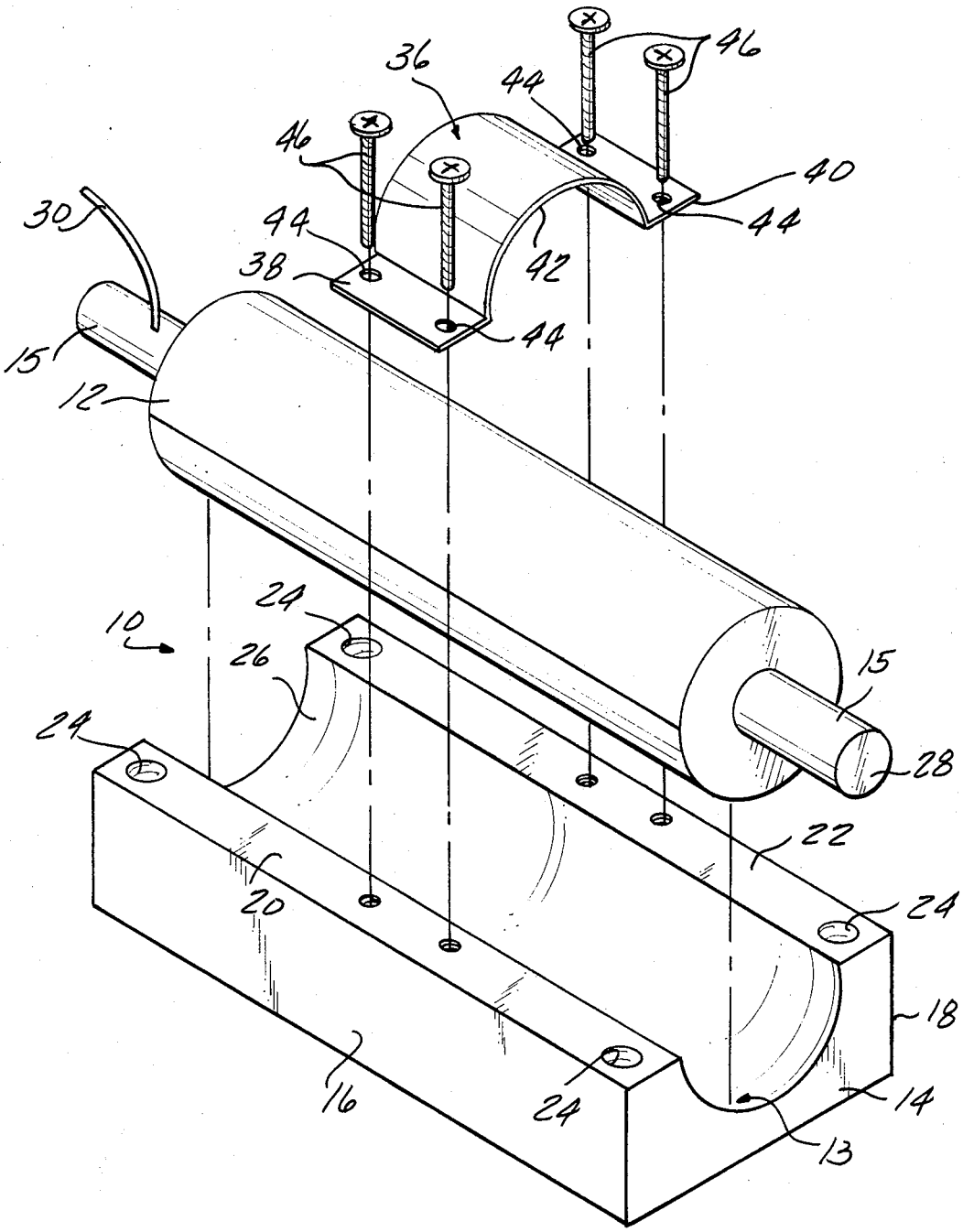
36
46
44
46
40
30
44
44
38
42
44
15
12
24
10
26
15
24
28
22
20
24
18
16
24
14
13

CAMERA TUBE DEFLECTION YOKE THERMAL SADDLE

BACKGROUND OF THE INVENTION

1. Field of the Invention

The present invention relates, in general, to camera tubes and, more specifically, to thermal heat sinks for deflection yokes used with camera tubes.

2. Description of the Prior Art

In modern camera equipment, it is typical to mount a camera tube deflection yoke in a housing to support the camera tube for receiving signals of images. During operation, the voltage and current applied to the camera tube and the deflection yoke cause heat to be generated which is normally radiated to the surrounding atmosphere in the housing. Due to the lower dissipation heat transfer rate of the yoke to the surrounding atmosphere, excessive heat builds up in the camera tube which requires that the camera tube be operated at a lower than maximum operating voltage. However, such lower voltage levels result in a lowering of the resolution of the camera.

Thus, it would be desirable to provide a camera apparatus which overcomes the problems of previous devised cameras insofar as maintaining maximum voltage on the camera tube during its operation. It would also be desirable to provide a camera apparatus which enables the camera to be operated at the highest permissible voltage to maximize the resolution of the camera tube.

SUMMARY OF THE INVENTION

The present invention is a thermal saddle for a camera tube deflection yoke which provides increased heat dissipation from the camera tube during its operation thereby enabling the use of higher operating voltages on the camera tube without loss of resolution from the camera. The thermal saddle includes a base having spaced, planar flanges which are mounted on the camera housing. A concave, central portion is formed between the spaced flanges and snugly receives and supports the camera tube deflection yoke between the two flanges. At least one and preferably a plurality of straps are provided for securing the deflection yoke to the base in a secure mounting position.

The thermal saddle of the present invention overcomes many of the problems encountered with previously devised camera tube deflection yoke mounting apparatus insofar as providing a unique heat sink which enables the camera tube to be operated at a maximum operating voltage thereby providing higher resolution than previously possible since the heat generated by such higher voltages is efficiently dissipated through the thermal saddle. The thermal saddle may be easily mounted within any existing camera housing and may be configured to receive any size camera tube deflection yoke.

BRIEF DESCRIPTION OF THE DRAWING

The various features, advantages and other uses of the present invention will become more apparent by referring to the following detailed description and drawing which illustrates an exploded, perspective view of the camera tube thermal saddle of the present invention.

DESCRIPTION OF THE PREFERRED EMBODIMENTS

Referring now to the drawing, there is illustrated a thermal saddle 10 which is used to mount a camera tube deflection yoke 12 within a camera housing, not shown, and for dissipating heat from the camera tube 15 during its operation to permit higher operating voltages to be applied to the camera tube 15.

The thermal saddle 10 includes a base 13 having a flat bottom 14 and opposed, perpendicularly extending side walls 16 and 18. The side walls 16 and 18 terminate in first and second spaced, horizontally extending opposed flanges 20 and 22, respectively. The flanges 20 and 22 have a planar configuration with a rectangular cross section. A plurality of apertures, such as apertures 24, are formed in opposite ends of the flanges 20 and 22 for securing the base 13 by suitable fasteners, not shown, to the camera housing.

The base 13 may be formed at any suitable high heat dissipation material, such as aluminum, steel, etc. It will be understood tht other materials may also be employed in constructing the base 13 as long as they provide a high heat dissipation rate for heat generated by the camera tube 15 and the deflection yoke 12.

Between the spaced flanges 20 and 22 there is formed a recessed, substantially concave center portion 26 which is configured in shape and diameter to receive and securely mount the deflection yoke 12 on the base 13.

The camera tube 15 may be any conventional tube, such as a Vidicon tube. Typically, such camera tubes 12 have a cylindrical shape with a circular cross section having an viewing aperture 28 at one end for receiving images and an output conductor 30 for conducting electrical signals through the tube 15.

Means 36 are provided for securely attaching the deflection yoke 15 to the base 13. Preferably, the mounting means 36 comprises a strap having two planar flange portions 38 and 40 with an arcuate, upwardly extending, central portion 42 integrally formed therebetween. The shape of the central portion 42 is configured to conform to the shape and diameter of the camera deflection yoke 15. Apertures 44 are formed in the flanges 38 and 40 and receive fasteners 46 to securely mount the mounting means 36 on the base 13. Although one mounting means 34 is shown in the drawing, it will be understood that a plurality of mounting straps 36 may be employed depending upon the length of the camera tube 12.

In summary, there has been disclosed a unique camera tube deflection yoke mounting device which provides increased heat dissipation to enable the camera tube to be operated at a maximum voltage thereby providing increased resolution and enhanced operating characteristics then that possible with previously devised camera mounting apparatus. The camera tube deflection yoke thermal saddle of the present invention is easily mounted within any conventional camera housing and is inexpensive in manufacturing cost.

What is claimed is:

1. In a camera having a camera tube deflection yoke, the improvement having a thermal heat sink, the heat sink comprising:

a base, the base having a bottom, upstanding side walls, and spaced top surfaces formed on the side walls and extending longitudinally along the length of the base, the base being formed of a thermal conductive material;

a recessed concave, central portion formed in the base and extending between the top surfaces of the side walls along the entire length of the base to receive the camera tube deflection yoke;

a clamp having first and second outwardly extending flanges with a central arcuate portion configured to surround a portion of the deflection yoke; and means for securing the flanges to the top surfaces of the base.

* * * * *